US010079007B2

(12) United States Patent
Rovner

(10) Patent No.: US 10,079,007 B2
(45) Date of Patent: Sep. 18, 2018

(54) WOODWIND MOUTHPIECE WITH V-NOTCH TABLE AND TONE CHAMBER INSERT

(71) Applicant: ROVNER PRODUCTS INCORPORATED, Timonium, MD (US)

(72) Inventor: Philip Lee Rovner, Timonium, MD (US)

(73) Assignee: ROVNER PRODUCTS INCORPORATED, Timonium, MD (US)

( * ) Notice: Subject to any disclaimer, the term of this patent is extended or adjusted under 35 U.S.C. 154(b) by 83 days.

(21) Appl. No.: 14/717,087

(22) Filed: May 20, 2015

(65) Prior Publication Data

US 2016/0343358 A1 Nov. 24, 2016

(51) Int. Cl.
*G10D 9/02* (2006.01)

(52) U.S. Cl.
CPC ..... *G10D 9/026* (2013.01)

(58) Field of Classification Search
CPC ..... G10D 9/02; G10D 9/00; G10D 9/043; G10D 7/10; G10D 9/023; G10D 7/00; G10G 5/00
USPC ..... 84/380 R, 383 R
See application file for complete search history.

(56) References Cited

U.S. PATENT DOCUMENTS 1,667,836 A 5/1928 Brockman, Jr.
1,771,157 A 7/1930 Paul
1,809,380 A 6/1931 Gulick
2,003,576 A 6/1935 Buhren
24,069,562 * 6/1935 Buhren ..... G10D 9/02 84/383 R
2,095,605 A 10/1937 Georges
2,181,880 A 12/1939 Fauss
2,224,308 A * 12/1940 Maccaferri ..... G10D 9/023 84/383 A
2,287,529 A 6/1942 Mario
2,296,737 A 9/1942 Peterson
2,368,556 A 1/1945 Maccaferri
2,411,692 A 11/1946 Murano
(Continued)

OTHER PUBLICATIONS

Passband, http://www.absoluteastronomy.com/topics/Passband viewed May 14, 2010.

(Continued)

*Primary Examiner* — Kimberly Lockett
(74) *Attorney, Agent, or Firm* — Patent Portfolio Builders PLLC

(57) ABSTRACT

A woodwind mouthpiece has a tone chamber with a bottom surface and a window. A table extends along an outer surface of the mouthpiece, and a pair of side rails extends from the table along opposite sides of the window. A removable tone chamber insert is disposed in the tone chamber in contact with the bottom surface and the interior surface of each side rail. The tone chamber insert modifies at least one of a tone chamber width defined by a distance between the interior surfaces of the side rails and a bottom surface width defined by a distance between the interior surfaces of the side rails at the bottom surface. In addition, a v-shaped notch extends into the table from the side rail top surfaces at least about 50% of the length of the table. the v-shaped notch defines an angle of at least about 15 degrees.

19 Claims, 3 Drawing Sheets

(56) References Cited

U.S. PATENT DOCUMENTS

| | | | | |
|---|---|---|---|---|
| 2,495,484 | A | 1/1950 | Schemenauer | |
| 2,499,855 | A | 3/1950 | Gamble | |
| 2,517,077 | A | 8/1950 | Berry | |
| 2,525,523 | A | 10/1950 | Chance | |
| 3,150,554 | A | 9/1964 | Leloup | |
| 3,433,113 | A | 3/1969 | Portnoy | |
| 3,521,517 | A | 7/1970 | Sato | |
| 3,759,132 | A | 9/1973 | Backus | |
| 3,905,268 | A | 9/1975 | Gamble | |
| 4,056,997 | A | 11/1977 | Rovner | |
| 4,210,055 | A | 7/1980 | Platamone, Jr. | |
| 4,308,781 | A | 1/1982 | Mcguerty | |
| 4,337,683 | A | 7/1982 | Backus | |
| 4,428,271 | A | 1/1984 | Winslow et al. | |
| 4,449,439 | A * | 5/1984 | Wells | G10D 9/02 84/383 R |
| 4,517,875 | A | 5/1985 | Dossekker | |
| 4,651,616 | A | 3/1987 | Visser | |
| 4,669,352 | A | 6/1987 | Bichon | |
| 4,708,182 | A | 11/1987 | Laker | |
| 4,745,838 | A | 5/1988 | Johnson | |
| 4,941,385 | A | 7/1990 | Johnson | |
| 5,018,425 | A | 5/1991 | Rovner | |
| 5,105,701 | A | 4/1992 | Hall et al. | |
| 5,192,821 | A | 3/1993 | Goldstein et al. | |
| 5,289,752 | A | 3/1994 | Barbaglia | |
| 5,293,805 | A | 3/1994 | Guardala et al. | |
| 5,303,628 | A | 4/1994 | Salazar | |
| 5,357,837 | A | 10/1994 | Disera | |
| 5,398,582 | A | 3/1995 | Smith | |
| 5,419,229 | A | 5/1995 | Van Doren | |
| 5,456,152 | A | 10/1995 | Cusack et al. | |
| 5,623,111 | A | 4/1997 | Van Doren et al. | |
| 5,728,957 | A | 3/1998 | Valtchev | |
| D404,755 | S | 1/1999 | Garbuzov | |
| 5,973,245 | A | 10/1999 | Van Doren | |
| 5,998,715 | A | 12/1999 | Rovner | |
| 6,020,545 | A | 2/2000 | Consoli | |
| 6,118,060 | A | 9/2000 | Van Doren | |
| 6,130,376 | A | 10/2000 | Chang | |
| 6,150,593 | A | 11/2000 | Holden | |
| 6,259,010 | B1 | 7/2001 | Nagahara | |
| 6,501,010 | B2 | 12/2002 | Sullivan | |
| 6,673,992 | B1 | 1/2004 | Runyon | |
| 7,169,993 | B2 | 1/2007 | Fliegel et al. | |
| 7,326,840 | B2 | 2/2008 | Wanne | |
| 7,465,864 | B2 | 12/2008 | Heintz | |
| 7,470,844 | B2 | 12/2008 | Espina | |
| 7,626,105 | B2 | 12/2009 | Rovner | |
| 7,635,287 | B2 | 12/2009 | May | |
| 7,638,700 | B1 | 12/2009 | Heintz | |
| 7,667,118 | B1 | 2/2010 | Behn | |
| 7,825,317 | B1 | 11/2010 | Lederman et al. | |
| 7,863,509 | B2 | 1/2011 | Rovner | |
| 7,939,738 | B2 | 5/2011 | Rovner | |
| 7,982,112 | B2 | 7/2011 | Rovner | |
| 8,283,541 | B2 | 10/2012 | Rovner | |
| 8,410,344 | B2 | 4/2013 | Rovner | |
| 8,586,845 | B2 | 11/2013 | Rovner | |
| 8,841,529 | B2 | 9/2014 | Rovner | |
| 2004/0011183 | A1 | 1/2004 | Fliegel et al. | |
| 2005/0061136 | A1 | 3/2005 | Rovner | |
| 2005/0061137 | A1 | 3/2005 | Rovner | |
| 2005/0072623 | A1 | 4/2005 | Rovner | |
| 2005/0087057 | A1 | 4/2005 | Taillard | |
| 2006/0123973 | A1 | 6/2006 | Espina | |
| 2006/0272473 | A1 | 12/2006 | Kuo | |
| 2008/0022839 | A1 | 1/2008 | Sullivan | |
| 2009/0217798 | A1 | 9/2009 | Rovner | |
| 2009/0217800 | A1 | 9/2009 | Rovner | |
| 2010/0043621 | A1 | 2/2010 | Rovner | |
| 2011/0162508 | A1 | 7/2011 | Rovner | |
| 2011/0239843 | A1 | 10/2011 | Brockman | |

OTHER PUBLICATIONS

Rovner ligatures, viewed May 14, 2010 at www.rovnerproducts.com/ligatures.com.

Article excerpts from "Downbeat" and "Clarinet Magazine" discussing the Rovner Barrel, 1979.

* cited by examiner

WOODWIND MOUTHPIECE WITH V-NOTCH TABLE AND TONE CHAMBER INSERT

FIELD OF THE INVENTION

The present invention relates to woodwind instruments and in particular to mouthpieces for woodwind instruments.

BACKGROUND OF THE INVENTION

Woodwind musical instruments, e.g., saxophones and clarinets, and other devices such as bird calls, utilize the vibration of a reed in response to a flow of air to generate a tone. These reeds include natural cane reeds and synthetic reeds. Tone generation in general depends on proper reed vibration. The reed is typically placed in contact with a mouthpiece to cover an opening or window. The reed is held in place by an adjustable clamp or ligature that surrounds the mouthpiece and the reed. Variations in the mouthpiece and ligature affect the vibration of the reed and, therefore, the performance or tone of the device or instrument.

The essential function of the mouthpiece of a woodwind instrument is to provide support for the reed over an aperture that allows the reed to vibrate and to direct the energy from the reed vibration through the aperture and into the bore of the instrument. The function and performance of a mouthpiece is influenced by the arrangement and geometry of the facing around the aperture as well as the tone chamber below the reed, which defines the route from the aperture to the bore. The tone chamber is conventionally formed as a rectangular box having straight interior walls and a flat generally rectangular bottom surface. The transitions from the top surfaces to the interior walls and from the interior walls to the bottom surface are right angles. The facing is conventionally a flat surface on the mouthpiece surrounding the aperture, and the reed is placed in contact with this flat surface, covering the aperture. The facing includes the aperture, called a window, and the window is surrounded by a table on one end, two side rails extending from the table and a tip rail opposite the table. The reed functions as a reed valve during vibration, opening and closing the window.

Unlike pianos, guitars, and similar musical instruments where the pitch of each note is precisely fixed, woodwind instruments require greater playing proficiency to achieve an acceptable level of pitch accuracy. Often, even after many years of study, many players are not able to satisfactorily produce good intonation absent significant effort. This problem is especially severe in hard rubber type mouthpieces. Hard rubber mouthpieces have a standardized external configuration that, in particular, is favored in the school-band venue. A major cause of the problem is the configuration of the window into the tone chamber that exists at the rear of the window in the standard configuration. The standard configuration produces, during operation, a shock front that tends to partially acoustically decouple the reed from the air column in the instrument. This permits the reed's own resonance to influence the air column resonance with regard to pitch. Therefore, if the reed's resonances are not directly or harmonically related to that of the air column, on a specific note, the air column frequency is pulled from the ideally produced frequency, causing the note to be out of tune. An accomplished player can correct this by way of nuanced changes in the position and pressure of the lip on the reed. However, if the effort to accomplish this can be reduced, the player can achieve the desired tone with less effort.

A conventional standard hard rubber woodwind mouthpiece has a geometry that transitions the rectangular geometry of the tone chamber to the circular central mouthpiece bore, often with an offset or abrupt change in cross-sectional geometry. In addition, the transition from the rear of the window to the table is either straight across the mouthpiece or has a slight round curvature. This transition creates an abutment at the rear of the window, resulting in an abrupt and generally flat surface. This abrupt change creates an impedance discontinuity. Anytime a discontinuity exists in an acoustic environment a shock front is created that causes reflections in two directions. This effectively creates a degree of isolation of one section of the vibrating air column from the opposite section. In a woodwind instrument this causes the coupling of the air column to the reed to be reduced, allowing the reed's resonances to influence the pitch. Therefore, a mouthpiece geometry is desired that eliminates this abrupt flat surface at the interface between the window and the table and provides tapered transitions from the sides walls and bottom surface of the tone chamber into the central bore of the mouthpiece.

SUMMARY OF THE INVENTION

The present invention is directed to woodwind mouthpieces that mitigate intonation problems by reconfiguring the internal cavities of single reed woodwind instrument mouthpieces, for example, the standard hard rubber mouthpieces, to provide a noticeable improvement in intonation, tonality and ease of performance. In one embodiment, the interface between the window and the table of the mouthpiece is modified from a straight or slightly curved shape to a v-shape, having an angle of from about 15 degrees to about 30 degrees. In one embodiment, the angle for the v-shaped notch or cavity edges is about 15 degrees on either side of the longitudinal or central axis of the woodwind mouthpiece, or an included angle of 30 degrees.

Exemplary embodiments of mouthpieces containing this v-shaped notch in the table generate additional wave fronts that are oblique and that add to the performance of the mouthpiece by providing for a more "centered" and less "spread" in the tone, for greater tonal presence, for more even scale, for improved response and facility, for greatly improved response of bottom notes of the saxophone, which typically, are more difficult to play and for more rich, sweeter tonal quality. In general, the v-shaped notch in the mouthpiece provides multiple wavefronts and utilizes impedance matching to achieve these results. The v-shaped notch in the table is suitable for both clarinet and saxophone mouthpieces.

Exemplary embodiments also include one or more molded shaped inserts that are placed in the tone chamber. These inserts can be removable and are provided as a user-selectable accessory to the woodwind mouthpiece. The insert is form fitted to the internal dimensions of the tone chamber and is held in place through friction and this matching form fit. The insert can be removable or could be secured in placed, for example, using an adhesive. The insert changes the internal dimensions and shape of the tone chamber, for example, to include tapered walls or conical shapes. The insert increases the versatility of the mouthpiece by broadening the available tonal range, for example, through the addition or removal of the insert or the selection of an insert with a desired geometry. In another embodiment, the bottom surface of the tone chamber is provided with a v-shaped groove to smooth the transition from the generally rectangular geometry of the tone chamber to the circular geometry of the central mouthpiece bore. The tone chamber bottom groove can be used with either one of the v-shaped table notch and the tone chamber inserts.

In accordance with one exemplary embodiment, the present invention is directed to a woodwind mouthpiece having a tone chamber within the mouthpiece, a generally rectangular window exposing the tone chamber, a table disposed on an outer surface of the mouthpiece and configured to engage a reed and in contact with the window and a notch extending into the table from the window. In one embodiment, the table extents along the outer surface of the mouthpiece a given length, and the notch extends into the table at least about 50% of the given length. Preferably, the notch extends into the table from about 50% of the given length to about 60% of the given length. In one embodiment, the notch is a v-shaped notch defining an angle of at least about 15 degrees, or at least about 30 degrees.

In one embodiment, the window extends along the mouthpiece from a first end, and the table is in contact with the window opposite the first end. The mouthpiece also includes a mouthpiece bore passing through the mouthpiece from a second end of the mouthpiece opposite the first end to the tone chamber, and the notch extends into the table a distance sufficient to expose at least a portion of the mouthpiece bore. In one embodiment, the tone chamber has a bottom surface opposite the window. The woodwind mouthpiece includes a pair of side rails extending from the table along opposite sides of the window. Each side rail has a side rail top surface and an interior surface running from the top surface to the bottom surface of the tone chamber. A removable tone chamber insert is disposed in the tone chamber in contact with the bottom surface and the interior surface of each side rail. The tone chamber insert modifies at least one of the tone chamber width, defined by a distance between the interior surfaces of the side rails, and the bottom surface width, defined by a distance between the interior surfaces of the side rails at the bottom surface.

In one embodiment, the tone chamber insert modifies the tone chamber width to be greater at the side rail top surface than at the bottom surface of the tone chamber. In addition, the tone chamber insert modifies the bottom surface width to narrow when extending along the bottom surface from at least one of a table end of the tone chamber adjacent the table and a first end of the tone chamber opposite the table end. In one embodiment, the tone chamber has a length from a table end of the tone chamber adjacent the table to a first end of the tone chamber opposite the table end. The tone chamber insert modifies the tone chamber width to have a tone chamber width tapered shape from the side rail top surfaces to the bottom surface of the tone chamber along at least a portion of the length. In addition, the tone chamber insert modifies the bottom surface width to define a bottom surface width tapered shape extending from at least one of the table end of the tone chamber or the first end of the tone chamber along at least a portion of the length. In one embodiment, a plurality of removable tone chamber inserts is provided. Each insert is arranged to be disposed in the tone chamber in contact with the bottom surface and the interior surface of each side rail and to provide a unique modification to at least one of the tone chamber width and the bottom surface width.

Exemplary embodiments are also directed to a woodwind mouthpiece having a tone chamber within the mouthpiece. The tone chamber includes a bottom surface, and the mouthpiece includes a generally rectangular window exposing the tone chamber. A table is disposed on an outer surface of the mouthpiece in contact with the window and is configured to engage a reed. A pair of side rails extends from the table along opposite sides of the window. Each side rail has a side rail top surface and an interior surface running from the top surface to the bottom surface of the tone chamber. A removable tone chamber insert is disposed in the tone chamber in contact with the bottom surface and the interior surface of each side rail to modify at least one of a tone chamber width, defined by a distance between the interior surfaces of the side rails, and a bottom surface width defined by a distance between the interior surfaces of the side rails at the bottom surface.

In one embodiment, the tone chamber insert modifies the tone chamber width to be greater at the side rail top surface than at the bottom surface of the tone chamber. In addition, the tone chamber insert modifies the bottom surface width to narrow when extending along the bottom surface from at least one of a table end of the tone chamber adjacent the table and a first end of the tone chamber opposite the table end. In one embodiment, the tone chamber has a length from a table end of the tone chamber adjacent the table to a first end of the tone chamber opposite the table end. The tone chamber insert modifies the tone chamber width to have a tone chamber width tapered shape from the side rail top surfaces to the bottom surface of the tone chamber along at least a portion of the length. In addition, the tone chamber insert modifies the bottom surface width to define a bottom surface width tapered shape extending from at least one of the table end of the tone chamber or the first end of the tone chamber along at least a portion of the length. In one embodiment, a plurality of removable tone chamber inserts is provided. Each insert is arranged to be disposed in the tone chamber in contact with the bottom surface and the interior surface of each side rail and to provide a unique modification to at least one of the tone chamber width and the bottom surface width.

In one exemplary embodiment, a woodwind mouthpiece has a tone chamber with a bottom surface, a generally rectangular window exposing the tone chamber and a table extending a given length along an outer surface of the mouthpiece and configured to engage a reed and in contact with the window. A pair of side rails extends from the table along opposite sides of the window. Each side rail has a side rail top surface and an interior surface running from the top surface to the bottom surface of the tone chamber. A removable tone chamber insert is disposed in the tone chamber in contact with the bottom surface and the interior surface of each side rail. The tone chamber insert modifies at least one of a tone chamber width, defined by a distance between the interior surfaces of the side rails, and a bottom surface width, defined by a distance between the interior surfaces of the side rails at the bottom surface. A v-shaped notch extends into the table from the side rail top surfaces at least about 50% of the given length and defining an angle of at least about 15 degrees.

In one embodiment, the notch extends into the table from about 50% of the given length to about 60% of the given length, and the v-shaped notch defines an angle of at least about 30 degrees. In one embodiment, the window extends along the mouthpiece from a first end, and the table is in contact with the window opposite the first end. The mouthpiece includes a mouthpiece bore passing through the mouthpiece from a second end of the mouthpiece opposite the first end to the tone chamber, and the notch extends into the table a distance sufficient to expose at least a portion of the mouthpiece bore.

DETAILED DESCRIPTION

Figure 1:
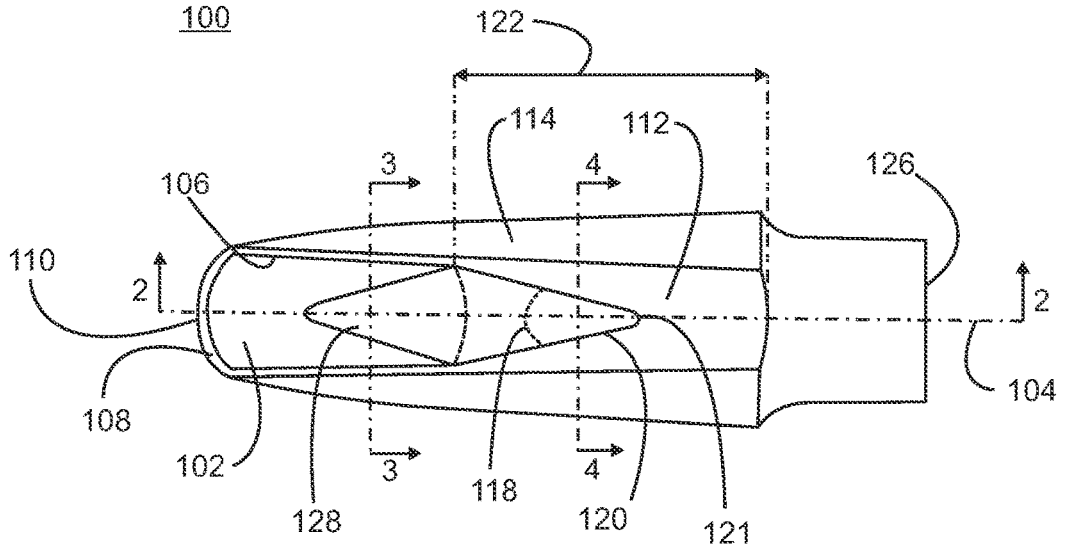
FIG. 1 is a view of an embodiment of the mouthpiece with a v-shaped notch in the table in accordance with the present invention.
Figure 2:
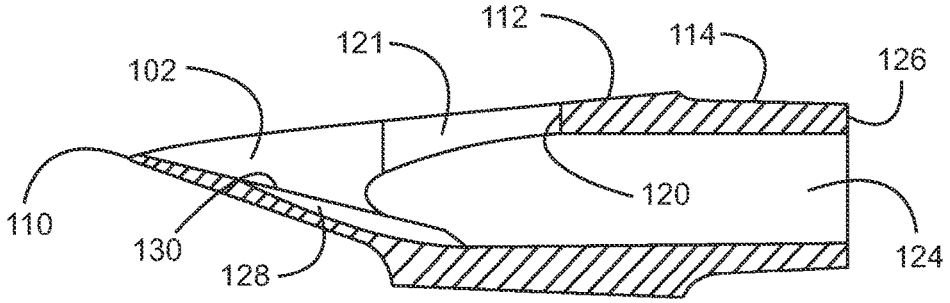
FIG. 2 is a view through line 2-2 of FIG. 1.
Figure 3:
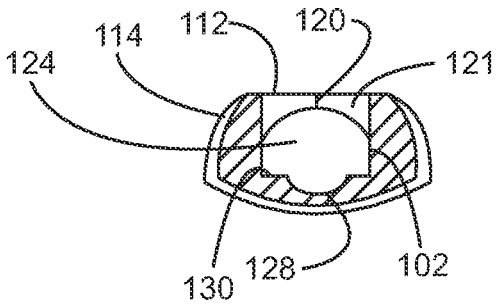
FIG. 3 is a view through line 3-3 of FIG. 1.
Figure 4:
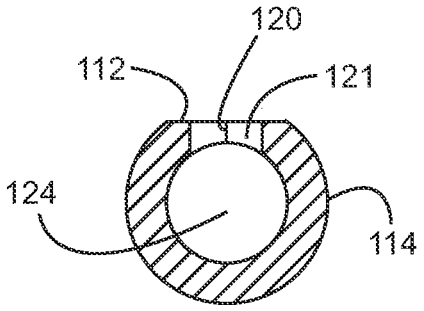
FIG. 4 is a view through line 4-4 of FIG. 1.

Referring initially to FIGS. 1-4, an exemplary embodiment of a woodwind mouthpiece 100 in accordance with the present invention is illustrated. The woodwind mouthpiece includes a tone chamber 102 disposed within the mouthpiece. Typically the tone chamber has a generally rectangular cross-sectional shape when view along the central axis 104 of the woodwind mouthpiece. A generally rectangular window 106 exposes the tone chamber. In one embodiment, the window narrows from a tip rail 108 at a first end 110 of the mouthpiece or window to a table end of the window located at the transition between the window and a table 112 that is disposed on an outer surface 114 of the mouthpiece. The table, which is in contact with the window, is configured to engage a reed and in particular, the heel end of the reed. A ligature (not shown) is placed around the reed and mouthpiece at the table to secure the reed to the mouthpiece. The window transitions to the table at a table end of the window opposite the first end. Conventionally, this transition between the window and the table is straight, i.e., perpendicular to the central axis, or is effectively straight, having only a slight curvature 116. The table extends along the outer surface of the mouthpiece a given length 122.

The woodwind mouthpiece includes a notch 121 in the table that extends into the table from the window. Preferably, the notch passes completely through the table and can have various shapes such as rectangular, semi-circular, elliptical and u-shaped. Preferably, the notch is a v-shaped notch. In one embodiment, the v-shaped notch is centered on the central axis 104 of the mouthpiece. The notch can also have more complex geometries such as a w-shaped notch or multiple identical notches spanning a width of the table perpendicular to the central axis. In one embodiment, the notch extends into the table to a point 120 that is located at least about 50% along the given length of the table. Preferably, the notch extends into the table from about 50% of the given length to about 60% along the given length. When the notch is a v-shaped notch, the notch defines an angle 118. This angle can be at least about 15 degrees and is preferably at least about 30 degrees. When measured with respect to the central axis 104, the angle is at least about 12.5 degree or preferably at least about 15 degrees. Although illustrated as symmetric with respect to the central axis with the point 120 located on the central axis, the notch can be a-symmetric or could be entirely contained on only one side of the central axis.

As illustrated, the window extends along the mouthpiece from the first end 110 and is in contact with the window opposite the first end. The mouthpiece includes a central mouthpiece bore 124 passing through the mouthpiece from a second end 126 of the mouthpiece opposite the first end to the tone chamber. In one embodiment, this central mouthpiece bore has a circular cross-section. In one embodiment, the notch extends into the table a distance sufficient to expose at least a portion of this mouthpiece bore. Therefore, the notch extends past the tone chamber portion of the mouthpiece to the central mouthpiece bore portion of the mouthpiece.

The notch extending into the table from the window effectively extends the window and eliminates the straight or substantially straight reflecting surface at the end of the window under the reed. A straight surface or even a surface having a slight curvature is perpendicular to the direction of the propagation of waves through the tone chamber and into the central bore. Therefore, all of the reflected wavefronts are identical or substantially identical and propagate in parallel to the direction of the central axis of the mouthpiece as these wavefronts are produced from the straight or substantially straight end of the table. The notch eliminates this straight surface and produces a plurality of wavefronts at varying angles that are oblique. This reduces the wavefronts reflected parallel to the axis of the mouthpiece. In addition, a net benefit of the oblique shock fronts that form at the edges of the notch is to broadband the air column resonances so that strong, specific resonant frequencies are reduced and the musical scale is made more even.

In one embodiment, the woodwind mouthpiece includes a groove 128 formed into the bottom surface 130 of the tone chamber 102. This groove has a smooth, curved profile (FIG. 2) along the central axis of the mouthpiece and provides a more gradual transition from the tone chamber 102 to the central bore 124 of the mouthpiece along the bottom surface of the tone chamber. In one embodiment, the tone chamber bottom surface groove is formed with a v-shaped profile when view from the window of the tone chamber (FIG. 1) and has a semi-circular or rounded cross section (FIG. 3) perpendicular to the central axis of the mouthpiece. In one embodiment, the geometry of the v-shaped profile is similar to the geometry of the v-shaped notch in the table. For example, the v-shaped groove is symmetric along the central axis of the mouthpiece and defines an angle of at least about 15 degrees and preferably at least about 30 degrees. In one embodiment, the v-shaped groove has a profile, when viewed from the window of the tone chamber that is a mirror image of the v-shaped notch in the table along a line perpendicular to the central axis of the mouthpiece. This line defines a transition point from the tone chamber window to the table.

Figure 5:
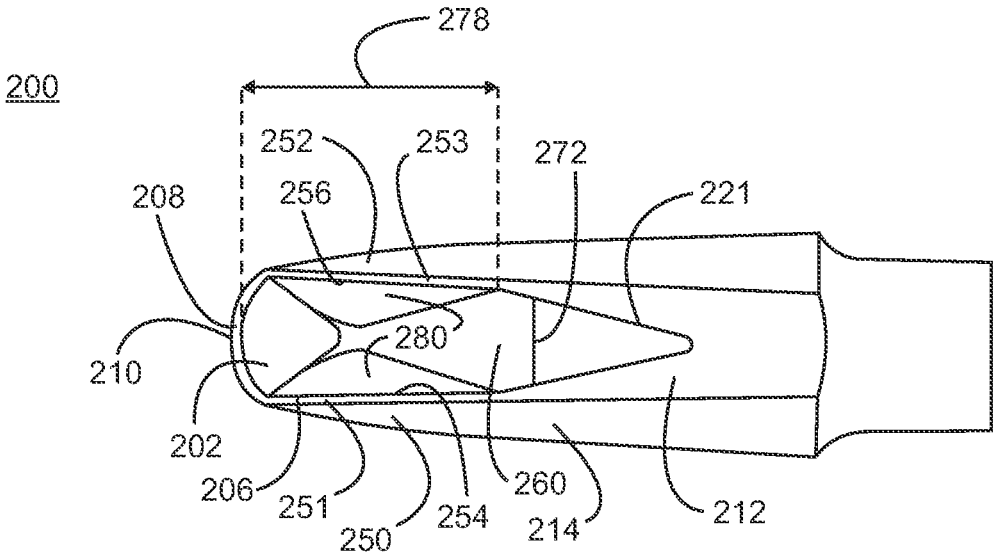
FIG. 5 is a view of another embodiment of the mouthpiece with a v-shaped notch and tone chamber insert in accordance with the present invention.

Referring to FIG. 5, another embodiment of the woodwind mouthpiece 200 having the v-shaped notch in the table and a tone chamber insert is illustrated. This embodiment of the woodwind mouthpiece includes the same general arrangement of features as described above. In particular, the woodwind mouthpiece includes a tone chamber 202 within the mouthpiece. Typically the tone chamber has a generally rectangular cross-sectional shape. A rectangular window 206 exposes the tone chamber. The tone chamber and window extend from a tip rail 208 at a first end 210 of the mouthpiece to a table 212 disposed on an outer surface 214 of the mouthpiece.

The woodwind mouthpiece includes a notch 221 that extends into the table from the window. Arrangements of the notch for this embodiment are the same as those discussed above. The tone chamber includes a bottom surface opposite the window. A pair of side rails 250, 252 extends from the table along opposite sides of the window. Each side rail has a side rail top surface 251, 253 and an interior surface 254, 256 running from the top surface to the bottom surface of the tone chamber. In one embodiment, the interior surfaces of the side rails meet the bottom surface of the tone chamber along the length of the tone chamber at substantially right angles, defining the rectangular cross section of the tone chamber.

A tone chamber insert 260 is disposed in the tone chamber. Preferably, the tone chamber insert is a removable insert that can be selectively placed in and removed from the tone chamber. The tone chamber insert is disposed in the tone chamber in contact with the bottom surface of the tone chamber and the interior surface of each side rail at least along a portion of the length of the bottom surface and each one of the interior surfaces of the side rails. The tone chamber insert modifies a tone chamber width defined by a distance between the interior surfaces of the side rails from the top surface of the side rails to the bottom surface and a bottom surface width defined by a distance between the interior surfaces of the side rails at the bottom surface from the tip rail to the mouthpiece central bore. These widths define the shape of the passage through the tone chamber when moving into the tone chamber from the window and along the tone chamber from the tip rail to the central bore.

In one embodiment, the tone chamber has a length 278 from a table end 272 of the tone chamber adjacent the table to the tip rail 208 at the first end 210 of the mouthpiece opposite the table end. The tone chamber insert modifies the tone chamber width to have a tone chamber width tapered shape from the side rail top surfaces to the bottom surface of the tone chamber along at least a portion of this length, and the tone chamber insert modifies the bottom surface width to define a bottom surface width tapered shape extending from at least one of the table end of the tone chamber or the first end of the tone chamber along at least a portion of the length.

Figure 6:
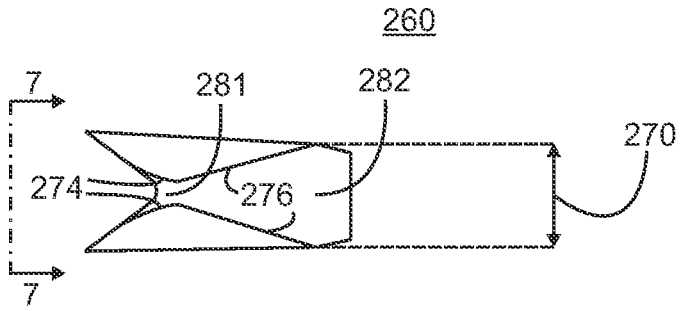
FIG. 6 is a view of an embodiment of a removable tone chamber insert.
Figure 7:
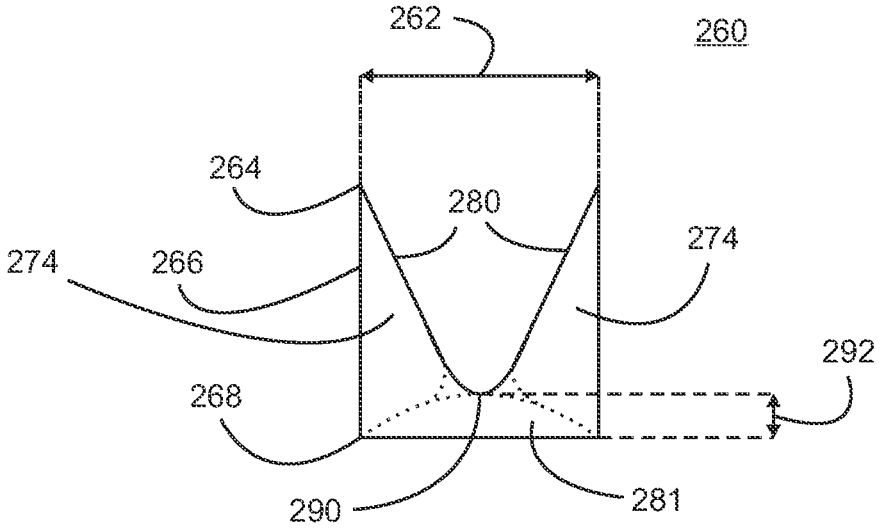
FIG. 7 is a view through line 7-7 of FIG. 6.

Referring to FIGS. 6 and 7, an embodiment of the removable tone chamber insert is illustrated. The tone chamber insert is formed with an exterior shape 266 that mates with the exterior shape of the tone chamber from the tip rail to the central bore and from the top of the side rails to the bottom surface of the tone chamber. The tone chamber insert modifies the tone chamber width 262 to be greater at a point 264 located at the side rail top surface than at a point 268 located at the bottom surface of the tone chamber. This narrowing is provided by a pair of side wall interior tapers 280 located within the insert. This narrowing or tapering of the tone chamber width from the window to the bottom surface of the tone chamber can be constant along the length of the tone chamber or can vary along the length of the tone chamber. In one embodiment, the tapering of the tone chamber width has a generally u-shaped or v-shaped cross section although other cross-sectional geometries can be used. For example, the width can vary from about 0.4375 inches to about 0.0625 inches or from about 0.5 inches to about 0.125 inches. In one embodiment, the tone chamber width is greater at the side rail top surface than at the bottom surface of the tone chamber along an entire length of the tone chamber from the tip rail to the central bore. Alternatively, the tone chamber width is greater at the side rail top surface than at the bottom surface of the tone chamber along only a portion of the length of the tone chamber from the tip rail to the central bore.

In addition, the tone chamber insert modifies the bottom surface width 270 to narrow when extending along the bottom surface from at least one of a table end 272 (FIG. 5) of the tone chamber adjacent the table and the tip rail 208 at the first end 210 of the mouthpiece opposite the table end. Suitable widths for the bottom surface include, but are not limited to, from about 0.0625 includes to about 0.625 inches. In one embodiment, first bottom width interior tapers 274 are provided from the first end of the tone chamber, and second bottom width interior tapers 276 are provided from the table end of the tone chamber. In one embodiment, the first bottom width interior tapers are identical to the second bottom width interior tapers. Alternatively, the first bottom width interior tapers are not identical to the second bottom width interior tapers. In general both the first and second bottom width interior tapers are generally u-shaped or v-shaped tapers. The first bottom width interior tapers have a larger width adjacent the first end of the tone chamber, and the second bottom width interior tapers have a larger width adjacent the table end of the tone chamber.

In one embodiment, the insert includes a first bottom surface transition 281 extending from the frame rail end of the tone chamber and a second bottom surface transition 282 extending from the table end of the tone chamber. These transitions are internal surface of the insert that slant upwards away from the bottom surface of the tone chamber to a point 290 that is a given height 292 above the tone chamber bottom surface. This point can be a single point located, for example, midway along the length of the tone chamber. Alternatively, this point extends along a portion of the length of the tone chamber. The tone chamber insert includes smooth transitions among all of these interior surfaces to provide a smooth transition of the tapers from the window, the first end and the table end of the tone chamber. Therefore, the insert provides a smooth transition along the length of the tone chamber, and in one embodiment defines substantially conical passages in the tone chamber.

In one embodiment, a plurality of removable tone chamber inserts is provided. Each insert is arranged to be disposed in the tone chamber in contact with the bottom surface and the interior surface of each side rail and to provide a unique modification to the tone chamber width and the bottom surface width. Therefore, the tone chamber inserts can be selected and used interchangeably based on the desired tonality. Suitable materials for the tone chamber insert include the same materials, e.g., hard rubber, for the woodwind mouthpiece. In addition, the tone chamber insert can be made of different material than the woodwind mouthpiece. For example, the tone chamber insert can be made of polymers or elastomers that are softer or more deformable than the materials of the mouthpiece. In one embodiment, the tone chamber insert is shaped to work with tone chambers having the groove on the bottom surface of the tone chamber. The shape of the tone chamber insert can provide a smooth transition with the shape of the groove or can completely cover the groove.

Varying both the tone chamber width and the bottom surface width creates a tone chamber having a tapered, triangular or conical cross section from side rail to side rail and a tapered, triangular or conical shape extending in from either the tip rail or the central bore. Preferably, the wider portion of the conically shaped tone chamber is disposed adjacent the tip rail or the central bore. The tapered or conical shape of the tone chamber follows the varying width of the tone chamber and bottom surface. Therefore, in one embodiment, the tapered or conical shape extends along the length of the tone chamber and the bottom surface from the tip rail to from about ¼ to about ½ of the length of the bottom surface. Although illustrated as a conical shape, other suitable shapes for the tone chamber include, but are not limited to, hemispherical, tulip shaped, trumpet shaped, elliptical and bi-conical. This produces a tone chamber with sides or side walls that taper or slope when moving from the top to the bottom of the tone chamber as well as when moving from the tip rail to the table, yielding an overall, three-dimensional shape that is generally conically or pyramidal. In general, this yields a shaped-charge type geometry in the tone chamber when viewed from the tip rail. Alternatively, the tone chamber can be formed as a linear shaped charge that has a generally consistent shape or taper along the length of the tone chamber from tip rail to table. As used herein, the linear shaped charged formation in the tone chamber refers to utilizing conical shapes or a v-shaped notch along at least a portion of the length of the tone chamber with a geometry in the v-notch that focuses the reflected energy to a point or along a line or plane running through the tone chamber. Such geometries are known, for example, in the field of shape charges for demolition applications. In yet another embodiment, combinations of the three-dimensional conical or pyramidal shape and the linear shaped charge arrangement for the tone chamber are provided. For example, a conical arrangement is provided adjacent the tip rail, and this arrangement blends into a linear, triangular or sloped cross-section when moving along the length of the tone chamber from the tip rail.

While it is apparent that the illustrative embodiments of the invention disclosed herein fulfill the objectives of the present invention, it is appreciated that numerous modifications and other embodiments may be devised by those skilled in the art. Additionally, feature(s) and/or element(s) from any embodiment may be used singly or in combination with other embodiment(s) and steps or elements from methods in accordance with the present invention can be executed or performed in any suitable order. Therefore, it will be understood that the appended claims are intended to cover all such modifications and embodiments, which would come within the spirit and scope of the present invention.

What is claimed is:

1. A woodwind mouthpiece comprising:

a tone chamber within the mouthpiece;

a generally rectangular window exposing the tone chamber;

a table disposed on an outer surface of the mouthpiece, configured to engage a reed and in contact with the window; and a notch extending into the table from the window.

2. The woodwind mouthpiece of claim 1, wherein:

the table extends along the outer surface of the mouthpiece a given length; and the notch extends into the table at least about 50% of the given length.

3. The woodwind mouthpiece of claim 2, wherein the notch extends into the table from about 50% of the given length to about 60% of the given length.

4. The woodwind mouthpiece of claim 1, wherein the notch comprises a v-shaped notch defining an angle of at least about 15 degrees.

5. The woodwind mouthpiece of claim 4, wherein the v-shaped notch defines an angle of at least about 30 degrees.

6. The woodwind mouthpiece of claim 1, wherein:

the window extends along the mouthpiece from a first end;

the table is in contact with the window opposite the first end;

the mouthpiece further comprises a mouthpiece bore passing through the mouthpiece from a second end of the mouthpiece opposite the first end to the tone chamber; and the notch extends into the table a distance sufficient to expose at least a portion of the mouthpiece bore.

7. The woodwind mouthpiece of claim 1, wherein:

the tone chamber comprises a bottom surface opposite the window; and the woodwind mouthpiece further comprises:

a pair of side rails extending from the table along opposite sides of the window, each side rail comprising a side rail top surface and an interior surface running from the top surface to the bottom surface of the tone chamber; and a removable tone chamber insert disposed in the tone chamber in contact with the bottom surface and the interior surface of each side rail, the tone chamber insert modifying at least one of a tone chamber width defined by a distance between the interior surfaces of the side rails and a bottom surface width defined by a distance between the interior surfaces of the side rails at the bottom surface.

8. The woodwind mouthpiece of claim 7, wherein the tone chamber insert modifies the tone chamber width to be greater at the side rail top surface than at the bottom surface of the tone chamber.

9. The woodwind mouthpiece of claim 7, wherein the tone chamber insert modifies the bottom surface width to narrow when extending along the bottom surface from at least one of a table end of the tone chamber adjacent the table and a first end of the tone chamber opposite the table end.

10. The woodwind mouthpiece of claim 7, wherein:

the tone chamber comprises a length from a table end of the tone chamber adjacent the table to a first end of the tone chamber opposite the table end;

the tone chamber insert modifies the tone chamber width to have a tone chamber width tapered shape from the side rail top surfaces to the bottom surface of the tone chamber along at least a portion of the length; and the tone chamber insert modifies the bottom surface width to define a bottom surface width tapered shape extending from at least one of the table end of the tone chamber or the first end of the tone chamber along at least a portion of the length.

11. The woodwind mouthpiece of claim 7, further comprising a plurality of removable tone chamber inserts, each insert arranged to be disposed in the tone chamber in contact with the bottom surface and the interior surface of each side rail and to provide a unique modification to at least one of the tone chamber width and the bottom surface width.

12. A woodwind mouthpiece comprising:

a tone chamber within the mouthpiece, the tone chamber comprising a bottom surface;

a generally rectangular window exposing the tone chamber;

a table disposed on an outer surface of the mouthpiece, configured to engage a reed and in contact with the window;

a pair of side rails extending from the table along opposite sides of the window, each side rail comprising a side rail top surface and an interior surface running from the top surface to the bottom surface of the tone chamber; and a removable tone chamber insert disposed in the tone chamber in contact with the bottom surface and the interior surface of each side rail, the tone chamber insert modifying at least one of a tone chamber width defined by a distance between the interior surfaces of the side rails and a bottom surface width defined by a distance between the interior surfaces of the side rails at the bottom surface.

13. The woodwind mouthpiece of claim 12, wherein the tone chamber insert modifies the tone chamber width to be greater at the side rail top surface than at the bottom surface of the tone chamber.

14. The woodwind mouthpiece of claim 12, wherein the tone chamber insert modifies the bottom surface width to narrow when extending along the bottom surface from at least one of a table end of the tone chamber adjacent the table and a first end of the tone chamber opposite the table end.

15. The woodwind mouthpiece of claim 12, wherein:

the tone chamber comprises a length from a table end of the tone chamber adjacent the table to a first end of the tone chamber opposite the table end;

the tone chamber insert modifies the tone chamber width to have a tone chamber width tapered shape from the side rail top surfaces to the bottom surface of the tone chamber along at least a portion of the length; and the tone chamber insert modifies the bottom surface width to define a bottom surface width tapered shape extending from at least one of the table end of the tone chamber or the first end of the tone chamber along at least a portion of the length.

16. The woodwind mouthpiece of claim 12, further comprising a plurality of removable tone chamber inserts, each insert arranged to be disposed in the tone chamber in contact with the bottom surface and the interior surface of each side rail and to provide a unique modification to at least one of the tone chamber width and the bottom surface width.

17. A woodwind mouthpiece comprising:

a tone chamber within the mouthpiece, the tone chamber comprising a bottom surface;

a generally rectangular window exposing the tone chamber;

a table extending a given length along an outer surface of the mouthpiece, configured to engage a reed and in contact with the window;

a pair of side rails extending from the table along opposite sides of the window, each side rail comprising a side rail top surface and an interior surface running from the top surface to the bottom surface of the tone chamber;

a removable tone chamber insert disposed in the tone chamber in contact with the bottom surface and the interior surface of each side rail, the tone chamber insert modifying at least one of a tone chamber width defined by a distance between the interior surfaces of the side rails and a bottom surface width defined by a distance between the interior surfaces of the side rails at the bottom surface; and a v-shaped notch extending into the table from the side rail top surfaces at least about 50% of the given length and defining an angle of at least about 15 degrees.

18. The woodwind mouthpiece of claim 17, wherein the notch extends into the table from about 50% of the given length to about 60% of the given length and the v-shaped notch defines an angle of at least about 30 degrees.

19. The woodwind mouthpiece of claim 17, wherein:

the window extends along the mouthpiece from a first end;

the table is in contact with the window opposite the first end;

the mouthpiece further comprises a mouthpiece bore passing through the mouthpiece from a second end of the mouthpiece opposite the first end to the tone chamber; and the notch extends into the table a distance sufficient to expose at least a portion of the mouthpiece bore.

* * * * *